United States Patent [19]

Greiner

[11] Patent Number: 4,836,457

[45] Date of Patent: Jun. 6, 1989

[54] SCREEN FOR COMMINUTING MACHINES

[75] Inventor: Gabriele Greiner, Mönchen-Gladbach, Fed. Rep. of Germany

[73] Assignee: Lindemann Maschinenfabrik G.m.b.H., Dusseldorf, Fed. Rep. of Germany

[21] Appl. No.: 76,278

[22] Filed: Jul. 22, 1987

[30] Foreign Application Priority Data

Jul. 23, 1986 [DE] Fed. Rep. of Germany ..... 3624826

[51] Int. Cl.[4] ..... B02C 13/286

[52] U.S. Cl. ..... 241/73; 241/88.4; 241/89.1; 241/89.2; 241/89.3; 241/189 R

[58] Field of Search ..... 241/285 B, 73, 186 R, 241/186.2, 189 R, 87, 87.1, 88, 88.1, 88.4, 89, 89.1, 89.2, 89.3

[56] References Cited

U.S. PATENT DOCUMENTS

Re. 28,368 3/1975 Bonarrigo ..... 241/88.4
1,182,575 5/1916 Langevin ..... 241/89 X
2,440,927 5/1948 Boss et al. .
4,226,375 10/1980 Cameron ..... 241/285 B X

FOREIGN PATENT DOCUMENTS 2225916 12/1973 Fed. Rep. of Germany .

*Primary Examiner*—Mark Rosenbaum
*Attorney, Agent, or Firm*—Toren, McGeady & Associates

[57] ABSTRACT

A comminuting machine for comminuting waste, recycleable material, ores, stones, coal and the like, comprises a rotor carrying comminuting tools and mounted for rotation about a horizontal axis in a housing. The housing has an inlet and at least one outlet region for discharging comminuted material. First and second layers are mounted for independent movement to the housing over the outlet region. One layer is provided with a grate for the passage of comminuted material. The other layer is provided with a plurality of punches which are insertable into openings through the grate for modifying or closing the openings.

10 Claims, 10 Drawing Sheets

SCREEN FOR COMMINUTING MACHINES

TECHNICAL FIELD OF THE INVENTION

The invention relates to the design, in the grate region, of a comminuting machine, especially for comminuting waste and recycable materials as well as ores, stone, coal and the like, the body of which is provided with at least one material inlet and with at least one grate in the outlet region, and supports a rotor fitted with comminuting tools and mounted on a horizontal axis.

BACKGROUND OF THE INVENTION AND PRIOR ART

A comminuting machine of this kind, which is however only intended for scrap metal, is described in DE-OS 22 25 916. In this known comminuting machine the construction in the region of the grate, or of the grate arranged in the outlet region, indirectly or directly affects the result of the comminution. Such machines are however less suitable for use in the field of waste and useful material processing, since the specific requirements as to the quality of the end product, for example with regard to different particle sizes or degree of fineness and/or density, can only be met by the deliberate employment of different outlet grates with different grate openings, which must be exchanged to meet the desired end result of the comminution. The down-time of the machine associated with each change of grate and the resulting loss of production of course have an uneconomic effect, since the total down-time can become considerable, depending on the frequency with which a change of grate is required for the desired result of the comminution or for a particular comminution treatment. Further negative factors, in addition to the down-time already mentioned, are the long slowing-down time of the rotor, which is generally heavy and must come to a standstill before each change of grate, and the relatively high labour costs associated with the grate changing or with the modification of the machine.

OBJECT OF THE INVENTION

The object of the invention is to mechanise the conversion of a comminuting machine of the kind referred to (but not restricted to the processing of scrap metal) so as so far as possible to obviate the disadvantages indicated above.

SUMMARY OF THE INVENTION

This is done, according to the invention, by constructing the grate or grates of a plurality of layers, displaceable relatively to one another, that form the operating elements. By means of a comminuting machine designed in this way a situation can be reached in which, by manipulation in the region of the grate or by relative displacement of the layers constituting the operating elements, comminuted material can be produced at any time in the course of operation, completely automatically and without exchanging the operating elements, with both a desired particle size and the required density. If, as in a further feature of the invention, the operating elements are constructed as interengaging perforated dies and punches, the punches can be displaced relative to the dies in a particularly advantageous way, according to the particle size or density required, so as to give a die that is open, closed or with the punch reaching or projecting through it and gives the desired end result in terms of comminution or density.

A particularly large variety of possible ways of manipulation is offered in further advantageous developments of the invention by constructions according to the sub-claims. By means of the different initial forms of the dies and/or punches different embodiments of the operating elements in the region of the grate can be obtained. By the feature or possibility of forming the punches with different geometric form, or of suitably matching the dies to the punches, the desired effect can be produced on the starting material to give the required result of comminution.

A further possibility, in an advantageous development of the invention, is to provide as the operating element, instead of the punch, a cover sheet covering the dies, giving the possibility of manipulation to an open or closed die or grate. Furthermore the operating elements can consist of displaceable layers with differently sized holes, with the additional possibility of different hole geometry. By different hole geometry is meant in particular, in the context of the invention, both different geometric forms of the holes, for example round or angular holes, and different arrangements of holes. As a result of these features, displacement or relative movement of the layers leads to overlapping between the holes that provides the desired results of comminution through appropriate manipulation.

The positioning of the operating elements relative to one another is preferably effected by mounting the layers forming the operating elements so as to be relatively displaceable either pivotably or laterally. This feature ensures particularly practical handling and time-saving control of the repositioning of the operating elements relative to one another without stopping and dismantling the machine, though preferably the repositioning is done in stages and through stops.

The invention or the device according to the invention offers the possibility, as the operators see to be necessary, of engaging or removing the comminuting element required for processing the material currently being supplied while the machine is in operation. For example, in processing timber waste in forestry some of the material supplied to the device according to the invention may be readily comminutable bark, but at times tougher branches and roots may be supplied that cannot be comminuted without further measures. In this case the operators can immediately adjust or change over the machine according to the invention to the changed operating conditions by engaging the punch so that it projects through the die openings, so that the branches or roots that are supplied are subjected to an additional comminuting effect by which they are much more intensively processed.

A further field of use to be considered is the scrap processing industry. For example, the processing of so-called cooling scrap (high-density scrap that is added towards the end of the melting process to kill and/or cool the charge) for steel works and foundries is particularly interesting.

According to their use, three kinds of cooling scrap are to be distinguished, for which at the same time special requirements as to density and/or dimensions have to be met:

Cooling scrap for the converter in converter steel works. This scrap has to have a density of at least 1.0 to 1.3 $t/m^3$.

Cooling scrap for the ladle, that is added during the metallurgical finishing treatment of the steel. This scrap must meet particular alloying conditions and be suitable for bunkering, since it is added via automated metering and supply plant. The density has to be from 1.6 to 1.7 $t/m^3$.

Cooling scrap for the casting ladle. This scrap has to have a density of about 7.0 $t/m^3$, so that it can penetrate through the slag layer into the molten metal when the bath is quiet. The dimensions should be approximately 15 to 20 mm diameter and 100 mm long.

By means of the device according to the invention it is possible, by movement or displacement of the layers of operating elements relative to one another, to produce different dimensions or overlapping of the holes that give both the necessary density and the desired dimensions.

In addition to the preceding examples it is of course possible to think of other fields of use and kinds of processing for the device according to the invention.

BRIEF DESCRIPTION OF THE DRAWINGS

Further details of the invention will now be explained with reference to the exemplary embodiments illustrated in the drawings, in which.

DETAILED DESCRIPTION OF PREFERRED EMBODIMENTS OF THE INVENTION

Figure 1:
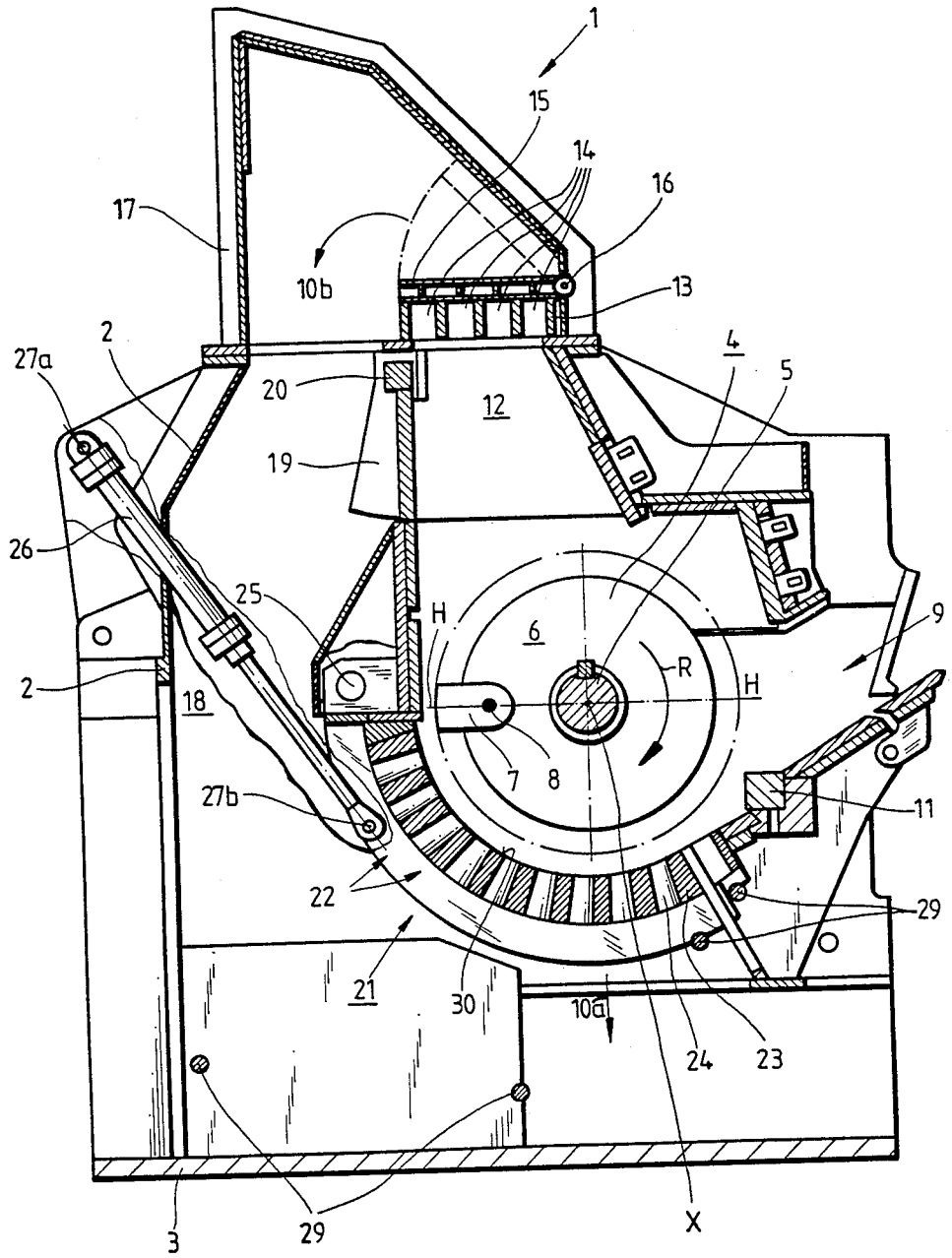
FIG. 1 shows a section through a comminuting machine according to the invention having in the grate region a closed lower body part or dies closed by the punches.

The comminuting machine indicated generally by 1 has a body 2 that stands on a base plate 3. In the body a comminuting rotor 4 rotates in the direction R, and has a shaft 5 mounted at both ends in bearings (not shown) fixed to bearing blocks. The rotor 4 consists of a plurality of rotor discs 6 spaced apart from one another on the shaft 5, between which comminuting tools 7, indicated only generally in the embodiment shown in FIG. 1, are mounted to rotate on axes 8 that pass through the rotor discs 6 spaced radially from the shaft 5 and parallel thereto. The shaft 5 is connected via a clutch plate (not shown) to a drive. An inlet 9 and outlets 10*a* and 10*b* for material are provided in the body 2. The material inlet 9 is arranged on the downwardly rotating side of the comminuting rotor 4 at the level of the horizontal plane H—H containing the rotor axis. The lower edge of the material inlet opening 9 is part of a replaceable anvil 11.

Below the material outlet 10*b*, which is on the side of the body 2 opposite to the inlet 9, the part of the body 2 lying above the comminuting rotor 4 is formed, in the embodiment illustrated, as an impact shaft 12 that is open above and below and whose height may for example be approximately that of the comminuting rotor. The impact shaft 12 is covered at the top with a classifying grate or outlet grate provided with screen openings 14 and extending at right angles to the axis of the impact shaft. The classifying or outlet grate 13 can be closed by a cover plate 15 mounted to be pivoted about an axis 16 by a hydraulic cylinder (not shown). By opening or closing the cover plate 15, as appropriate, the desired comminution and final density can also be influenced. Above the classifying screen 13 is arranged a hood 17 on which the material that is thrown out of the grate openings when the flap 15 is open is deflected downwards to pass out through an opening 18. Any uncomminutable large pieces that may be rotating in the body 2 can be thrown out through a flap 19 pivotable about an axis 20 in the impact shaft 12.

The second material outlet 10*a* that is also in the form of a screen and is arranged after the material inlet 9 in the direction of rotation R of the rotor 9 is, according to the invention, formed in the following manner.

The arcuate body part or parts 21 containing the grate or grates is or are, in the embodiment illustrated, built up in the radial direction of a plurality of layers forming operating elements 22, the operating elements 22 in the embodiment illustrated being formed as interengaging dies 23 and punches 24 and being moveable or pivotable relative to one another. Preferred shapes or forms of dies according to the invention are described in more detail below. In the sense of the invention grates formed according to the invention can however be arranged and provided at any position in the machine body, for example in the bottom of the body (as shown), as a cover of a discharge, grate lying above the rotor, or as a lateral discharge grate, for example in any spatial position.

Figure 8:
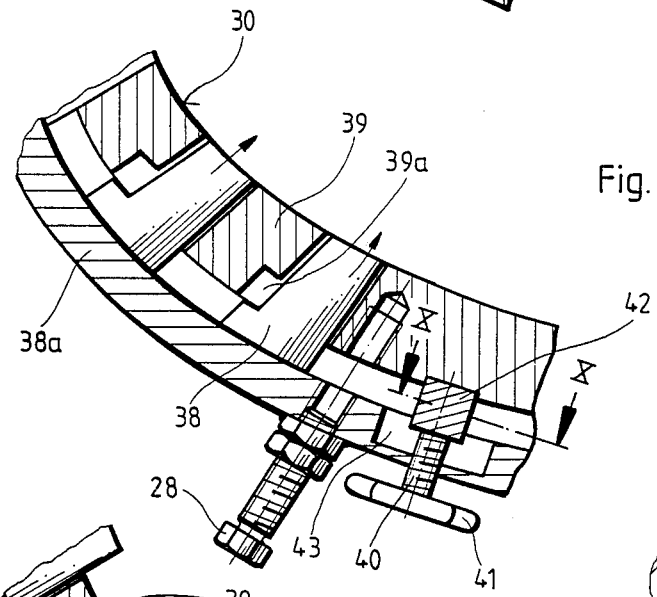
FIG. 8 shows an enlarged partial section of the comminuting machine shown in FIG. 5 with the alternative form of die shown in FIG. 7.
Figure 9:
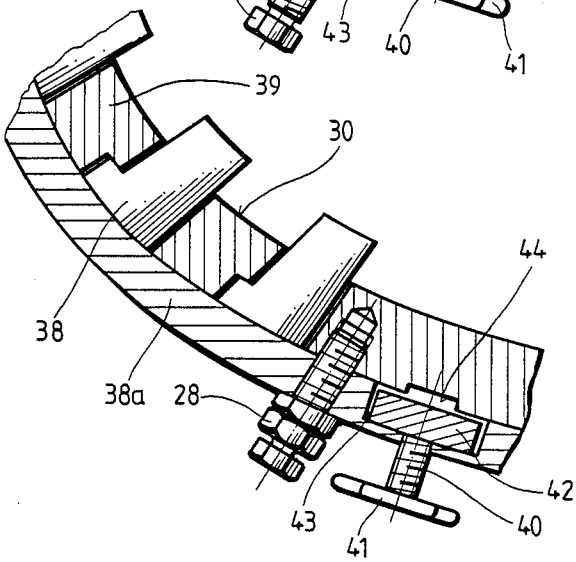
FIG. 9 shows the dies according to FIG. 8 with punches passing through them.

The dies 23 and punches 24 are mounted to pivot on a common axis 25. Two hydraulic cylinders 26, fastened via linkages 27*a* and 27*b* at one end to the punches 24 and at the other end to the body 2 of the comminuting machine 1, are used for opening and closing the dies and for passing the punches through, i.e. projecting them through or penetrating, the dies, and to swing the punches 24 and/or the dies 23 into the various desired positions that are necessary to provide the particle size or fineness and/or density required. In order to be able to move or swivel the dies 23 as well as by the means of swivelling the punches 24, appropriate coupling elements 28 are provided in the embodiment illustrated, for example a connecting screw as shown in FIGS. 8 and 9, to connect the dies 23 and the punches 24 together.

Alternatively there are other technical possibilities of effecting the swivelling movement of the dies 23, for example by means of two additional hydraulic cylinders that also control the dies 23 independently of the swivelling movement of the punches 24. An additional coupling element such as is required in the case just explained, is then superfluous.

Figure 2:
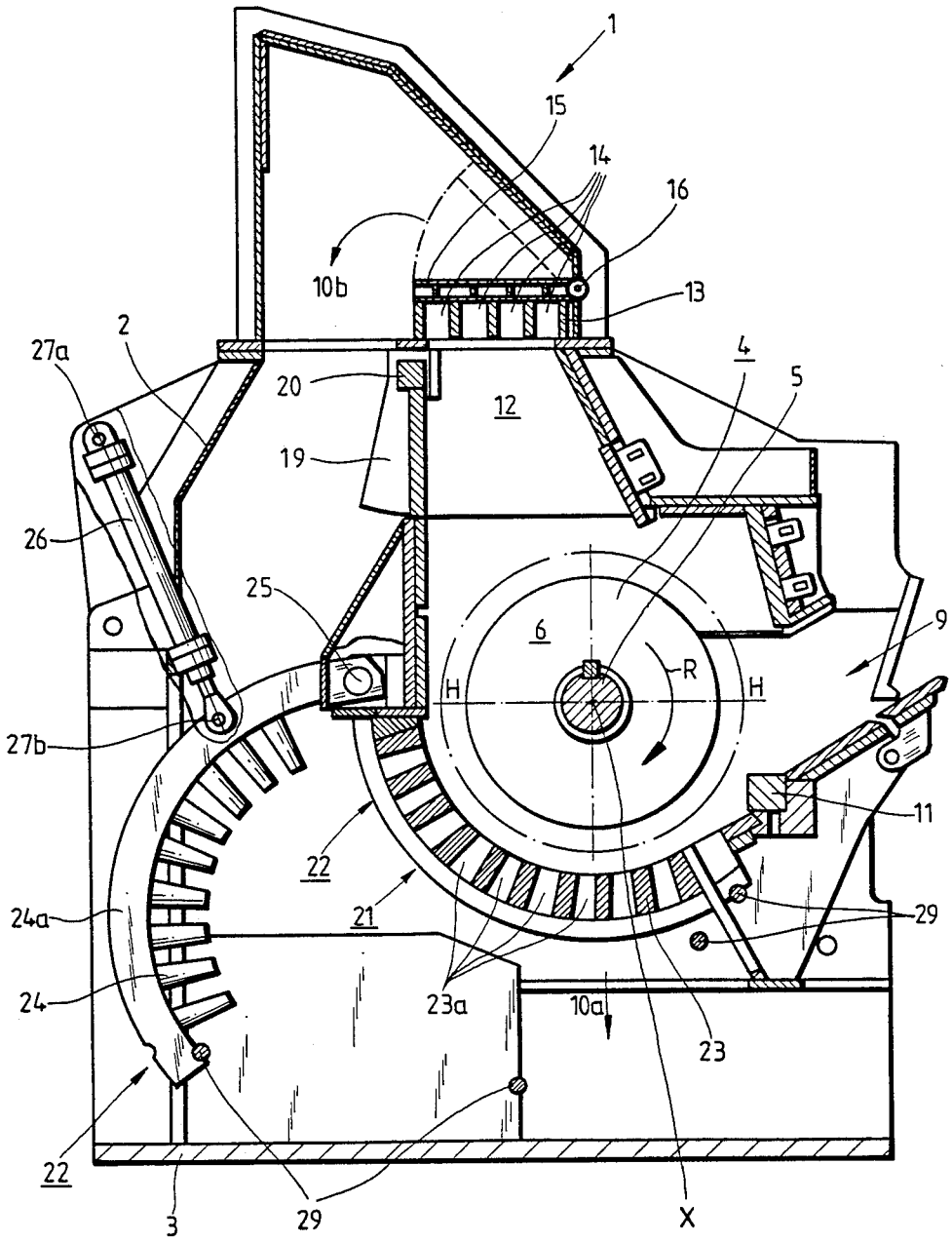
FIG. 2 shows the comminuting machine according to FIG. 1 with punches swung out of the dies.

The individual working, final and exchanging positions of the dies 23 and/or the punches 24 are aligned or set by corresponding stop elements, e.g. indexing pins 29. FIGS. 1 to 6 only represent some of the many different possible ways of manipulation in the region of the grate in the part 21 of the body containing the material outlet 10*a* that are possible by means of the layers forming the operating elements 22, in the embodiment illustrated by means of dies 23 and punches 24. In the embodiment shown in FIG. 1 the bottom of the body 30 or the dies 23 constitute the grate-containing part 21 of the body of the comminuting machine. The punches 24 are in the swungin position and engage in the dies 23. In this way a closed bottom 30 is formed for the body. By corresponding manipulation of the upper grate 13 or by means of the cover plate 15 in the region of the material outlet 10*b*, i.e. by opening or closing this grate 13, further effects can be produced on the size and density etc. of the fragments by means of the possibility of exerting influence through the operating elements 22 in the region of the lower grate. The possibility of manipulation by means of the upper grate 13 is however only one of many possibilities, and is not essential for the operation of the comminuting machine 1. If the punches 24 are swivelled out of the operating region of the dies of the 23, as shown in FIG. 2, a corresponding classifying effect is produced through the die openings 23*a* that are now freed, and this has a corresponding effect on the size and/or density of the fragments or the fineness of the material being comminuted.

Figure 3:
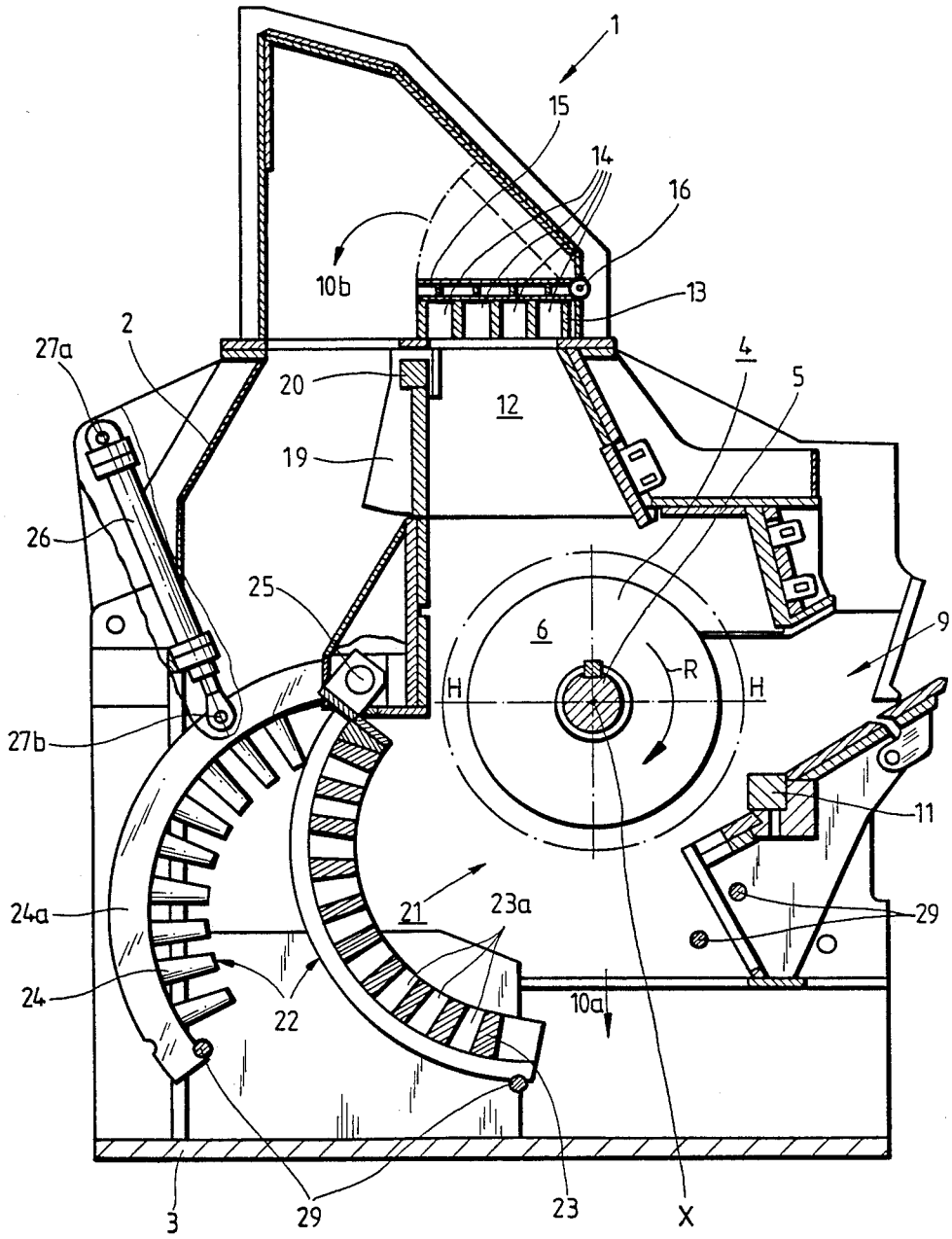
FIG. 3 shows the comminuting machine according to FIG. 2 with the lower part of the body open or with dies and punches swung out of the working area.
Figure 12:
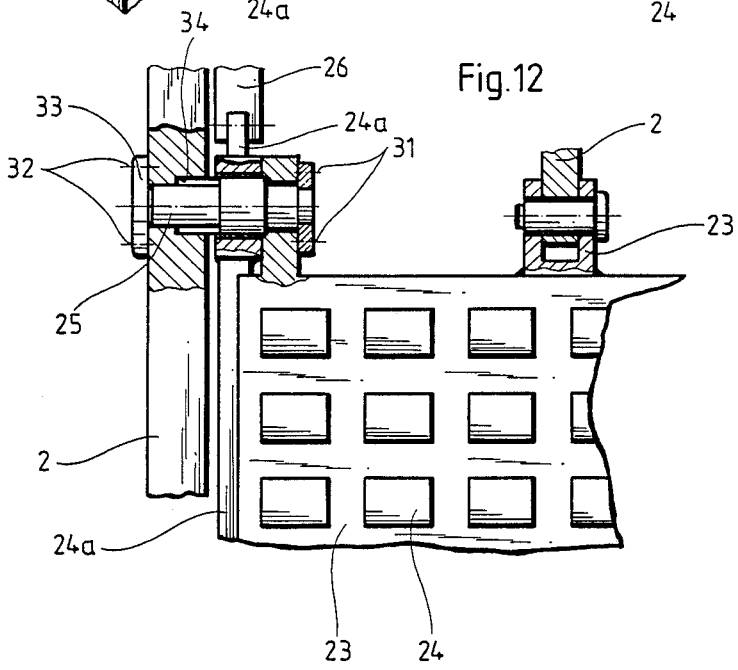
FIG. 12 shows one of the bearings of an exchangeable pivotably mounted die and punch in the body.

In the position shown in FIG. 3 the operating elements 22, in this case dies 23 and/or punches 24, can be relatively easily exchanged for other operating elements 22. For this purpose (see also FIG. 12) the fasteners 31 that are screwed to the dies 23 to secure the swivelling axle and the fasteners 32 that fix the head 33 of the swivelling axle 25 to the body 2 must first be released. The swivelling axle 25 can then be withdrawn outwards into the recess 34 in the housing 2 so that the dies 23 are freed to be exchanged downwards.

Figure 11:
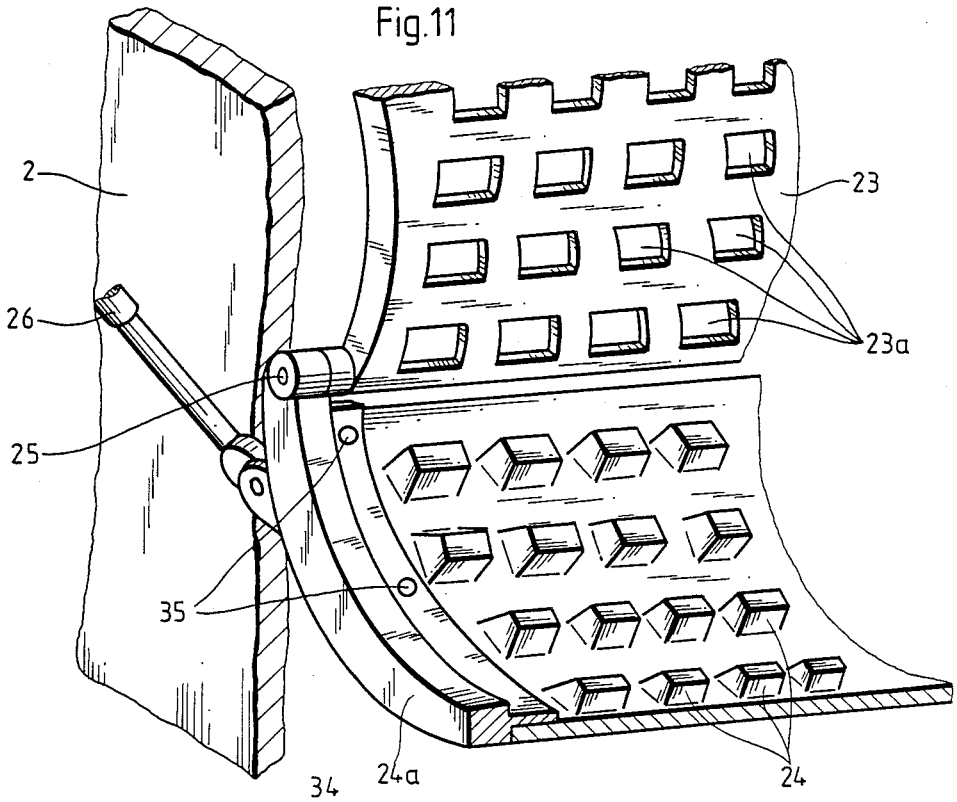
FIG. 11 shows a partial perspective view of the dies and punches with the dies hinged upwards.

The punch part 24 is screwed to a frame 24*a* so that this too can be exchanged at any time without great effort for any other punches, simply by releasing the fasteners, for example the screws shown in FIG. 11.

Figure 4:
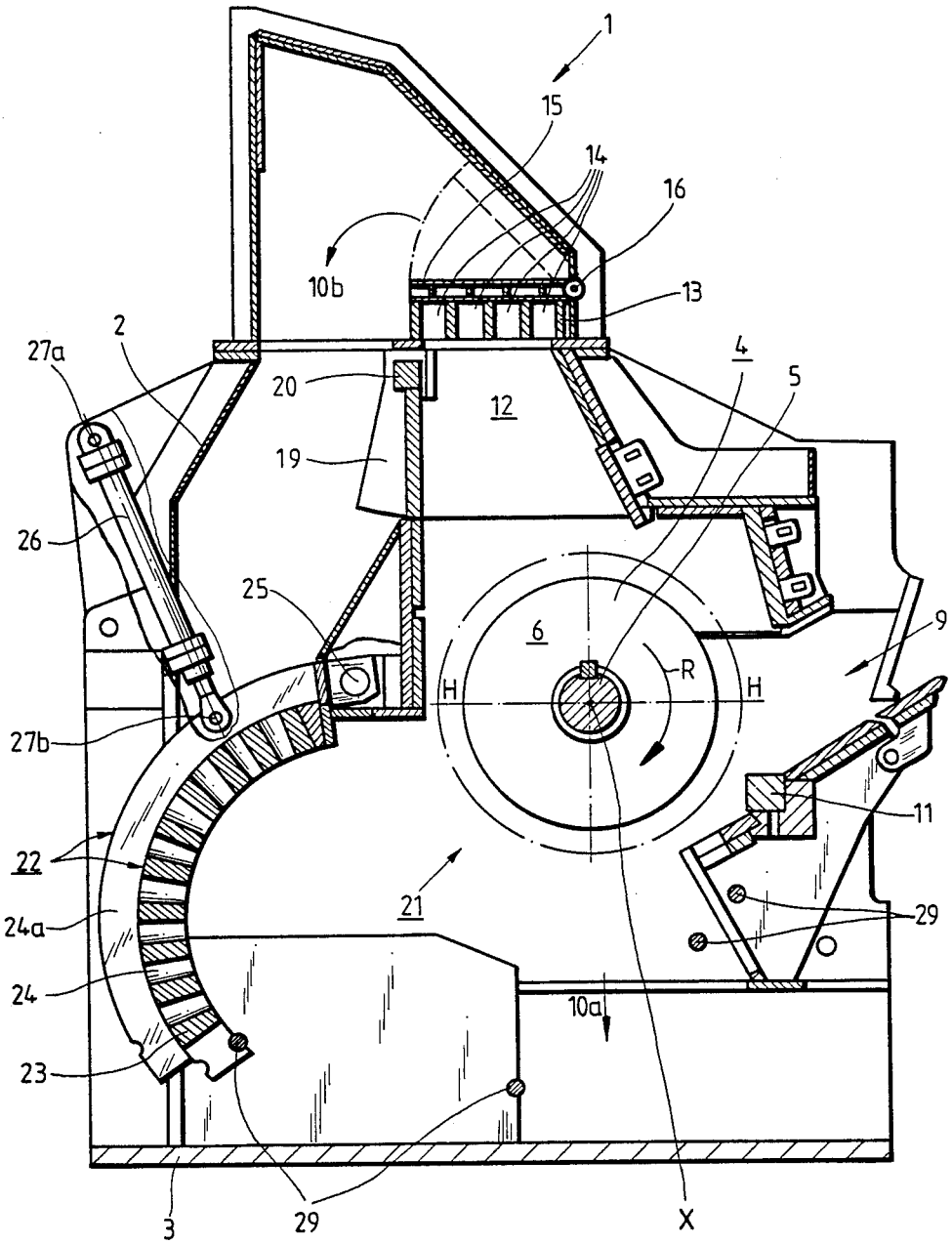
FIG. 4 shows the comminuting machine according to FIG. 1 with dies and punches combined and swung out.
Figure 5:
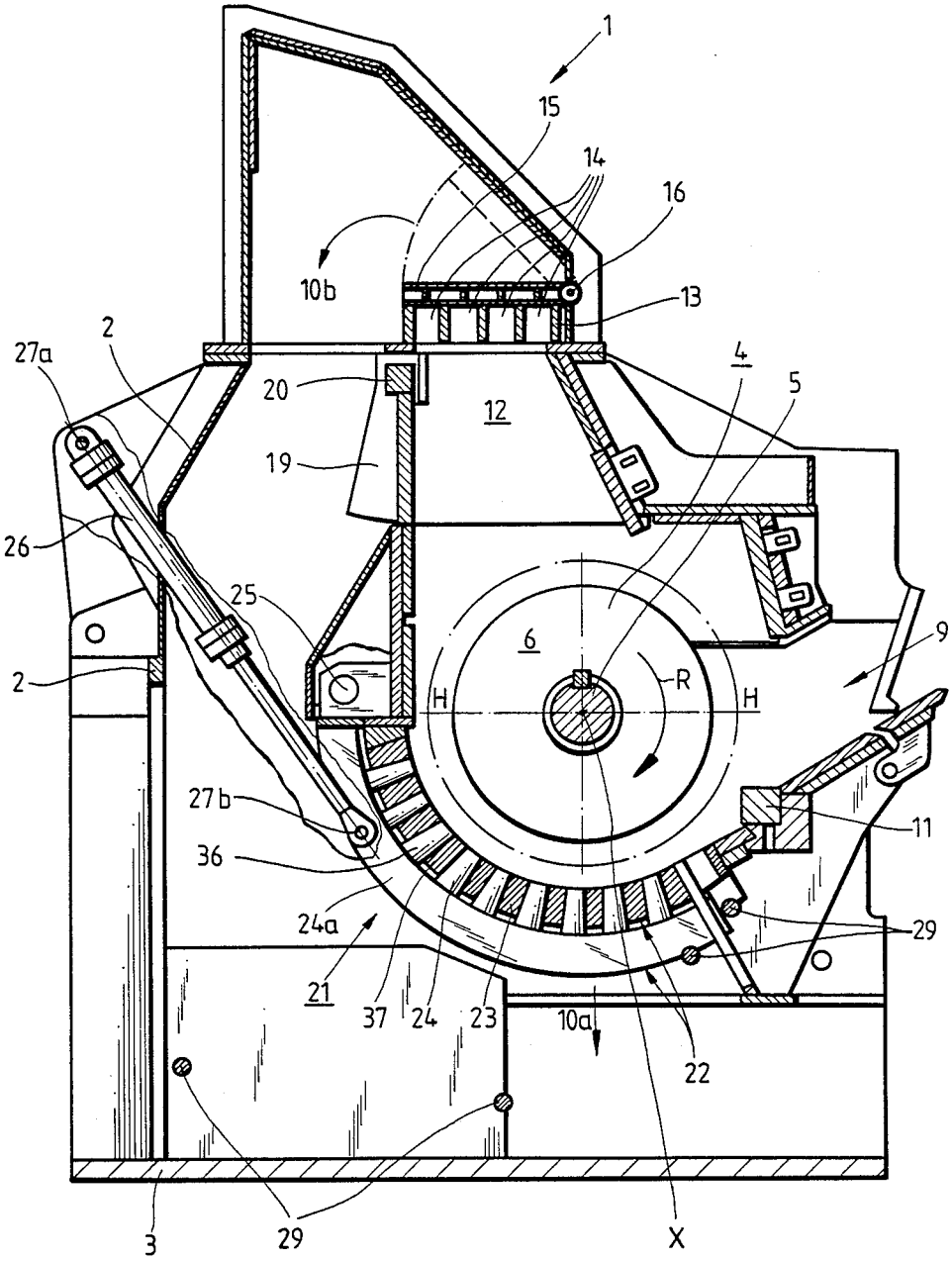
FIG. 5 shows an alternative embodiment of the comminuting machine in a view corresponding to that of FIG. 1, with the lower part of its body closed in the region of the grate or with the dies closed by the punches.
Figure 6:
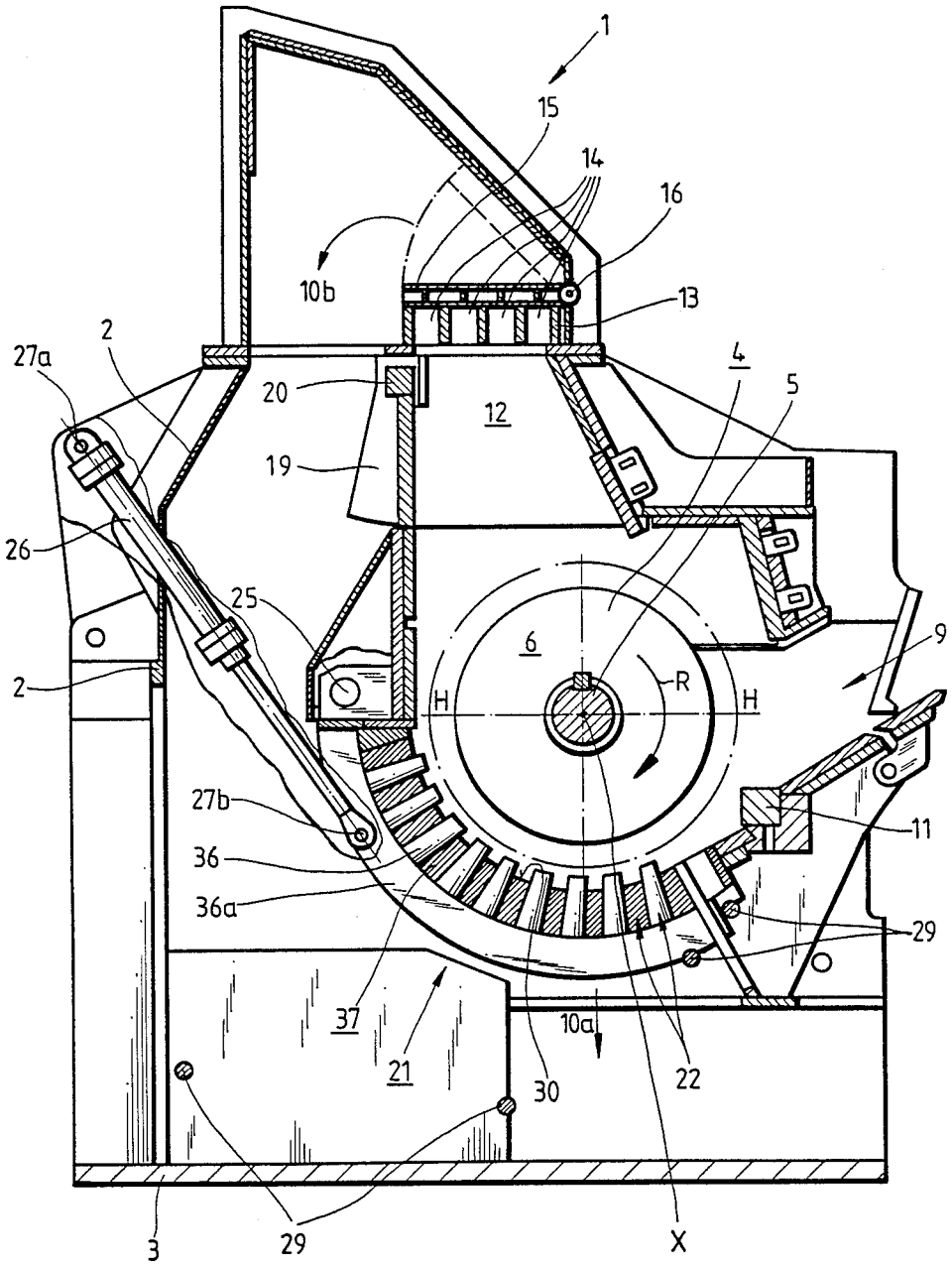
FIG. 6 shows the comminuting machine according to FIG. 5 with punches passing through the dies.

FIG. 4 shows, by way of example, a position of the operating elements 22 in which servicing operations can be carried out on the comminuting machine particularly easily, and also stoppages of material that may occur can be cleared. If the punch 36 is formed so that, as shown in FIG. 6, its raised part engages or is pushed through the die 37 and projects beyond the inner surface 30 of the die, a grinding or tearing action is obtained on some materials, or for example in the case of scrap there is a so-called "cushion effect" that protects the bottom 30 of the body from wear. In addition, by briefly pushing the raised parts of the punch through the die 37, the die openings 37*a* can be cleaned out and/or, in the case of materials that clog up easily, freed from blockages.

Figure 7:
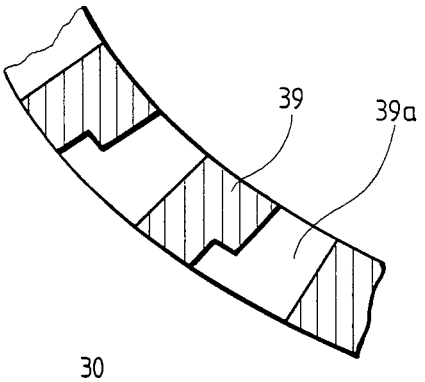
FIG. 7 shows an enlarged section of part of an alternative form of die.
Figure 10:
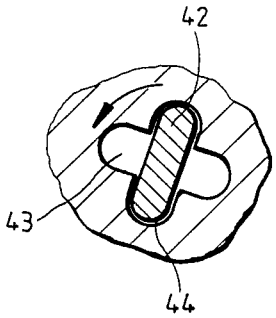
FIG. 10 shows a section along the line X—X in FIG. 8.

FIG. 7 shows an alternative form of die 39 in which the die openings 39*a* act as stops by having a suitable form, preferably a substantially L-shaped cross-section. In order to keep the punch 38 spaced from die 39 when it is desired to have a closed part or bottom 30 of the body, so that the die openings 39*a* are snugly closed by the punch 38 or the raised parts thereof that project into the die, a spacer 42 may for example be arranged on a threaded bolt 40 that passes through the punch 39 and is provided with a turn button 41. The spacer 42 is, as can be seen from FIG. 8, aligned and set in slots 43, 44 of different depths arranged as a cross in the punch frame 38*a* (see FIG. 10) by lifting up and turning. If on the other hand another fragment size or density of the end product is desired, the spacer can be lowered into the lower slot 43 by appropriate turning of the turn-button 41, and thus of the spacer 42, whereby the die 39 is correspondingly lowered and the punch 38 is forced through the die openings 39*a*, as shown in FIG. 9.

By various suitable arrangements or adjustments and/or dimensioning of the raised parts 24, 36, 38 of the punch that engage in the die openings 23*a*, 37*a*, 39*a* (see FIG. 13) it is possible to obtain active die passages of different geometric shape, that again can produce different effects or actions on the material being processed. By forming the punch in other different ways, for example as a tearing element or friction element, etc., additional ways of influencing the degree of comminution are possible.

Figure 13:
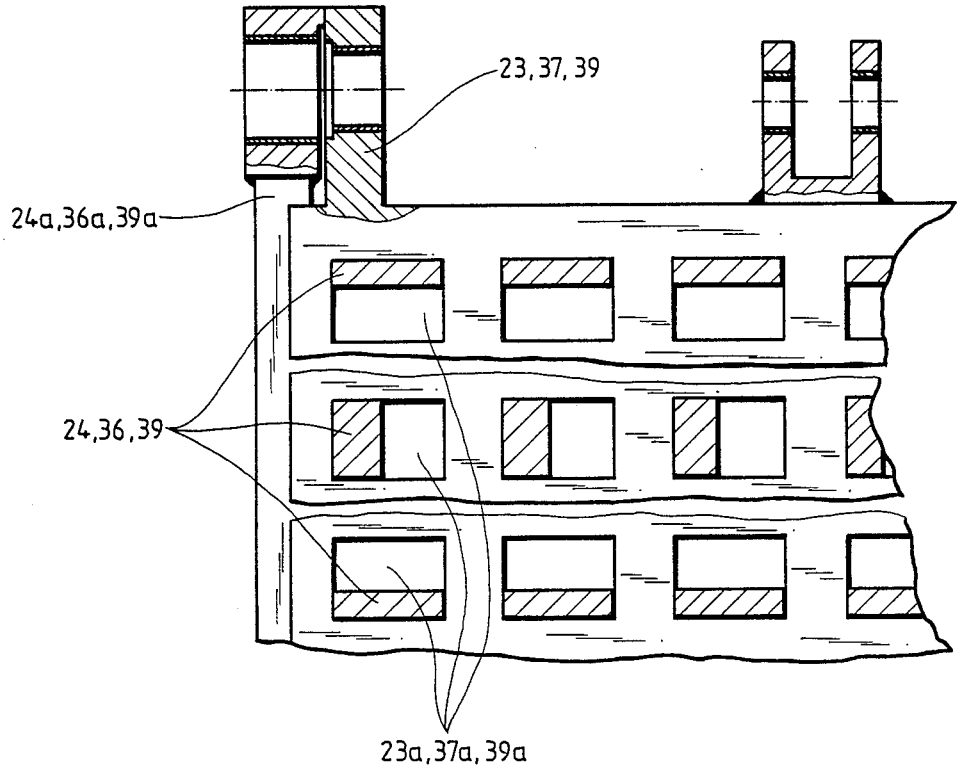
FIG. 13 shows various embodiments or possible forms of a die with a punch passing through it and FIG. 14 is a view which is identical to FIG. 2, except for the presence of a cover sheet, rather than the punches of FIG. 2.

FIG. 13 shows only a few of the many different possible forms for the raised parts 24, 36, 39 of punches that engage in the die openings 23*a*, 37*a*, 39*a*.

Figure 14:
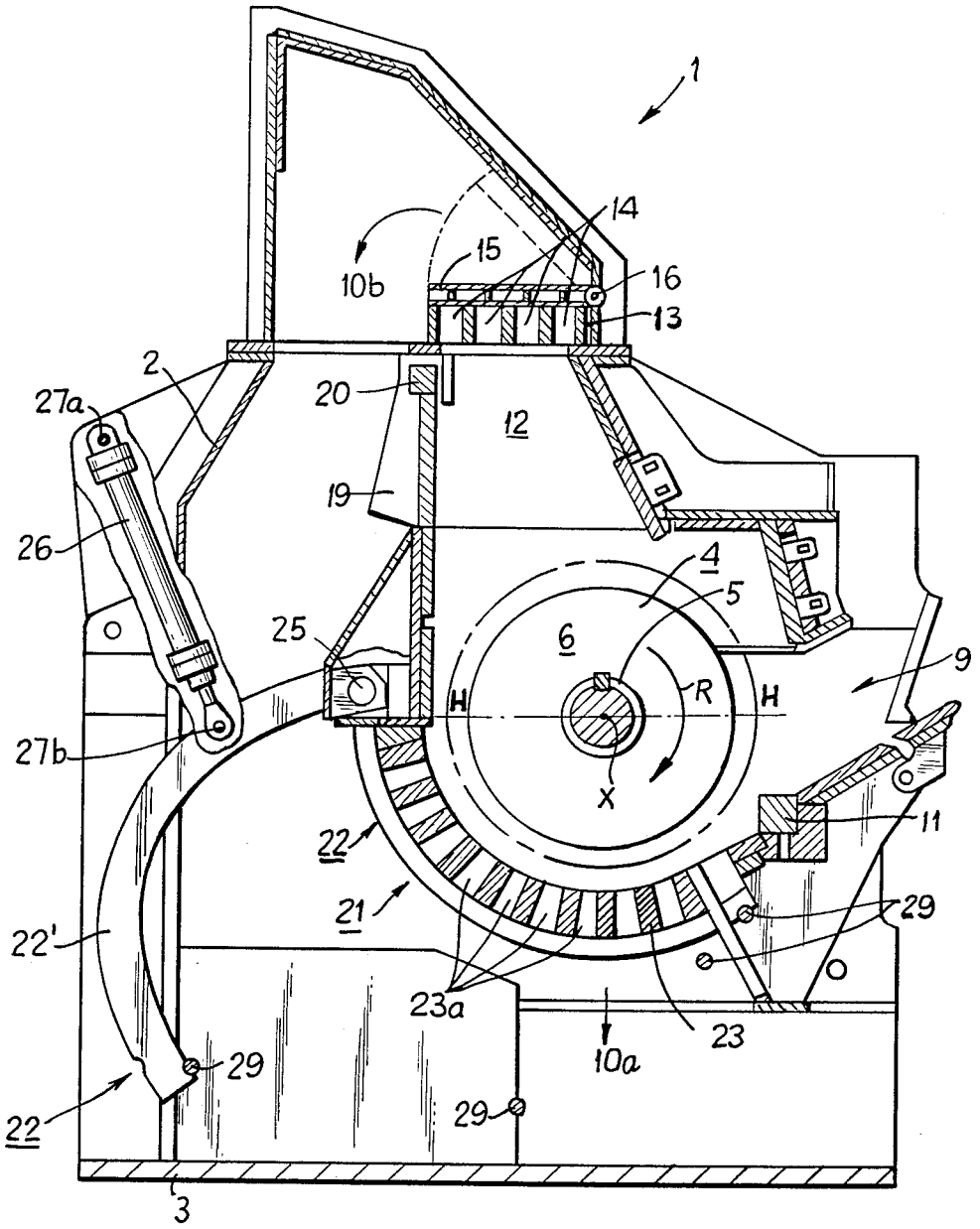

With suitable constructional arrangements there is the further possibility illustrated in FIG. 14 of replacing the punch by a sheet 22' that covers the die openings 23*a*, 37*a*, 39*a* so as to produce a closed die or lower part of the body—referring to the preceding embodiments—and, if desired, a die with open die openings, with which for example a normal classifying action can be produced. In addition the punches 24, 36, 38 can project both into the hammer-blow planes and between the hammer-blow planes in the body 2.

The dies and punches shown in the embodiments do not have to be made in one piece: within the scope of the invention they can also be divided radially, i.e. made in two parts, so as to make possible the kinds of manipulation indicated above for the case of one-piece construction by the arrangement of suitable additional adjusting means.

What is claimed is:

1. In a comminuting machine, in particular for comminuting waste and recyclable materials, ores and stones, wherein a rotor having comminuting tools thereon is rotatably mounted about a horizontal axis within a housing body and the housing body has an inlet and at least one outlet region for discharging comminuted material with at least one grate being arranged in the outlet region, the improvement comprising:

said grate being formed of first and second layers, means operatively connected to said layers for relative movement between said layers, said first layer having a plurality of grate openings therethrough, said second layer including at least one member capable of reducing the size of at least one of said openings when said layers are engaged with each other, said grate openings having a maximum effective size with said second layer moved by said means out of engagement from said first layer, which effective size cannot be increased by engaging said first and second layers with each other, said first layer comprising an operating element mounted for movement to said body, said at least one member comprising a punch connected to said operating element for engagement into one of said grate openings for changing the effective shape of said grate opening.

2. A machine according to claim 1 including a plurality of members each comprising a punch and each mounted on said operating element, said punches arranged in a pattern corresponding to a pattern of said grate openings so that each punch engages into one of said grate opening.

3. A machine according to claim 2 wherein each punch is shaped to fill and close a respective grate opening into which said punch is insertable when said layers are moved by said means into engagement with each other.

4. A machine according to claim 1 wherein said punch has a height which is greater than a depth of said grate opening into which said punch is insertable whereby said punch is extendable into said body beyond said first layer when said first and second layers are engaged with each other.

5. A machine according to claim 1 wherein said punch and said grate opening into which said punch is insertable are both L-shaped in cross-section.

6. A machine according to claim 1 wherein said punch is shaped to only partly fill said grate opening into which said punch is insertable with engagement of said first and second layers.

7. A machine according to claim 1 including a plurality of members each for engaging into a different one of said grate openings when said first and second layers are engaged with each other, said members having different shapes than said openings.

8. In a comminuting machine, in particular for comminuting waste and recyclable materials, ores and stones, wherein a rotor having comminuting tools thereon is rotatably mounted about a horizontal axis within a housing body and the housing body has an inlet and at least one outlet region for discharging comminuted material with at least one grate being arranged in the outlet region, the improvement comprising:

said grate being formed of first and second layers, means operatively connected to said layers for relative movement between said layers, said first layer having a plurality of grate openings therethrough, said second layer including at least one member capable of reducing the size of at least one of said openings when said layers are engaged with each other, said grate openings having a maximum effective size with said second layer moved by said means out of engagement from said first layer, which effective size cannot be increased by engaging said first and second layers with each other, said second layer including a plurality of members each for engagement into a separate one of said grate openings, said first and second layers each being arcuate and being pivotally connected to said body, said second layer comprising an operating element, said members projecting from said operating element into said grate openings with said first and second layers engaged against each other.

9. In a comminuting machine for comminuting waste and recyclable materials as well as ores, stones and coal, wherein a rotor having comminuting tools is rotatably mounted about a horizontal axis within a housing, and the housing has an inlet and at least one outlet region for the discharge of comminuted material with at least one grate being arranged in the outlet region, the improvement which comprises that said grate is formed of a plurality of layer portions comprising first and second members capable of interaction with each other, said first members comprising female members for the passage of comminuted material, means being provided for relative movement between said layer portions with the provision that the size of said female members is not enlargeable by relative movement between said layer portions when said layer portions are in contact with each other, said second members comprising male members each insertable into a separate one of said female members.

10. The improvement of claim 9 wherein each of said layer portions are pivotally mounted to said housing and are arcuate in shape.

* * * * *